US006471445B2

(12) United States Patent
Stansfield

(10) Patent No.: US 6,471,445 B2
(45) Date of Patent: Oct. 29, 2002

(54) ROTARY DISPLACEMENT PILING EQUIPMENT

(75) Inventor: Lewis Stansfield, Surrey (GB)

(73) Assignee: Compagnie du Sol, Nanterre (FR)

( * ) Notice: Subject to any disclaimer, the term of this patent is extended or adjusted under 35 U.S.C. 154(b) by 0 days.

(21) Appl. No.: 09/764,184

(22) Filed: Jan. 17, 2001

(65) Prior Publication Data

US 2001/0009204 A1 Jul. 26, 2001

(30) Foreign Application Priority Data

Jan. 20, 2000 (GB) ..... 0001323

(51) Int. Cl.[7] ..... E02D 7/00; E02D 13/00; E21B 10/44

(52) U.S. Cl. ..... 405/232; 405/239; 405/249; 405/257; 175/84; 175/391; 175/394

(58) Field of Search ..... 405/231, 232, 405/233, 235, 239, 241, 243, 249, 250, 256, 257, 132, 133; 175/171, 84, 162, 87, 391, 394, 202, 203, 220; 173/46, 104, 105

(56) References Cited

U.S. PATENT DOCUMENTS

| | | | | | |
|---|---|---|---|---|---|
| 3,390,730 | A | * | 7/1968 | Techy et al. | 175/171 |
| 3,645,343 | A | * | 2/1972 | Mays | 173/46 X |
| 3,833,072 | A | * | 9/1974 | Back | 175/171 X |
| 3,848,683 | A | * | 11/1974 | Persson | 175/171 X |
| 3,871,617 | A | * | 3/1975 | Majima | 405/232 X |
| 4,202,416 | A | * | 5/1980 | Blaschke et al. | 175/171 X |
| 4,232,752 | A | * | 11/1980 | Hauk et al. | 175/171 X |
| 4,458,765 | A | * | 7/1984 | Feklin et al. | 175/394 X |
| 5,281,775 | A | * | 1/1994 | Gremillion | 175/22 X |
| 5,722,498 | A | * | 3/1998 | Van Impe et al. | 175/394 |
| RE36,556 | E | * | 2/2000 | Smith et al. | 175/45 |
| 6,039,508 | A | * | 3/2000 | White | 405/232 |
| 6,047,771 | A | * | 4/2000 | Roynestad | 175/162 X |

FOREIGN PATENT DOCUMENTS

| | | | | |
|---|---|---|---|---|
| DE | 3919824 | * | 12/1990 | 405/232 |
| GB | 2133821 | * | 8/1984 | 170/394 |
| JP | 02164915 | * | 6/1990 | 405/232 |
| JP | 04089916 | * | 3/1992 | 405/232 |

* cited by examiner

*Primary Examiner*—Heather Shackelford
*Assistant Examiner*—Jong-Suk Lee
(74) *Attorney, Agent, or Firm*—Merchant & Gould P.C.

(57) ABSTRACT

A rotary displacement piling equipment for boring a hole within the soil includes a rotary displacement bit, driving rod members connected to the bit, a casing surrounding the driving rod member, and a casing adapter having a lower end provided with a cylindrical collar for co-operating with the upper part of the casing for keeping in line the casing with respect to the driving rod member and with an horizontal thrust face for applying a thrust at the upper end of the casing, the driving rod member passing through the casing adapter. The equipment may also include a rotary drive box co-operating with the driving rod member for rotating the driving rod means and provided with connecting member to be connected to the upper end of the casing adapter, and vertical supporting and guiding member for supporting and vertically guiding the rotary drive box.

9 Claims, 9 Drawing Sheets

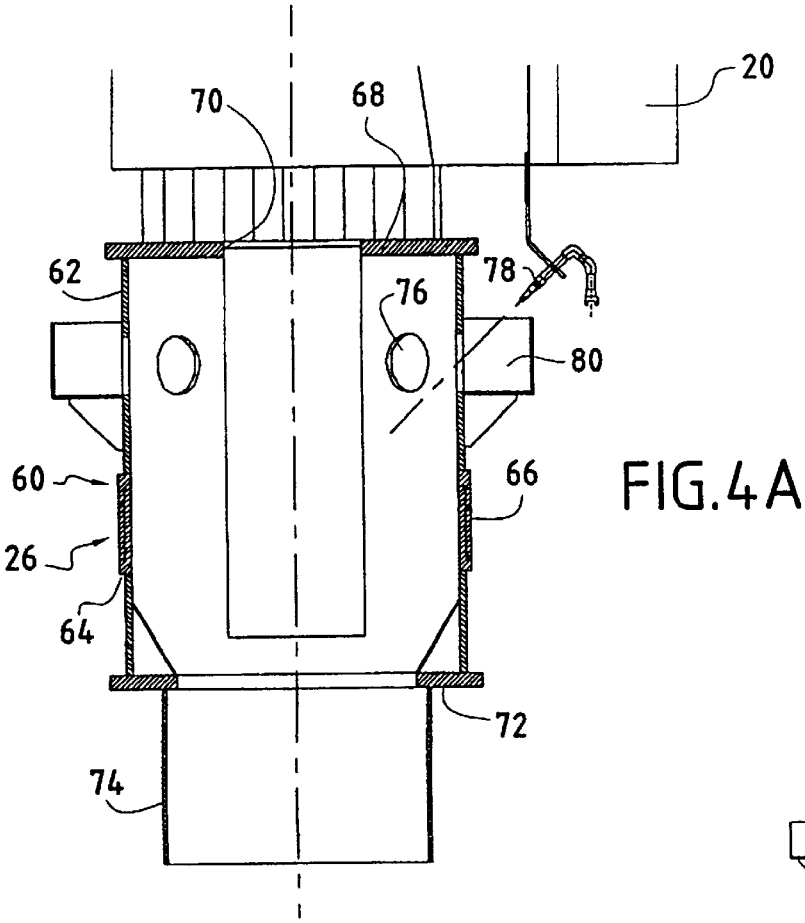
FIG.4A
FIG.4B
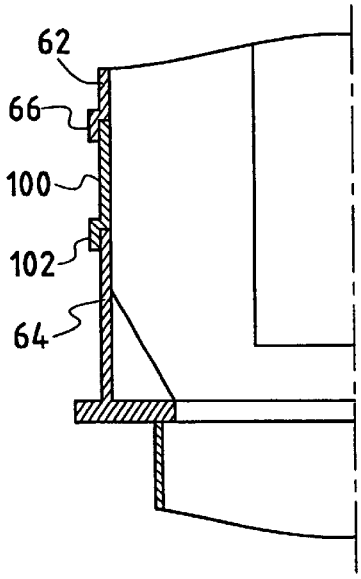
FIG.5
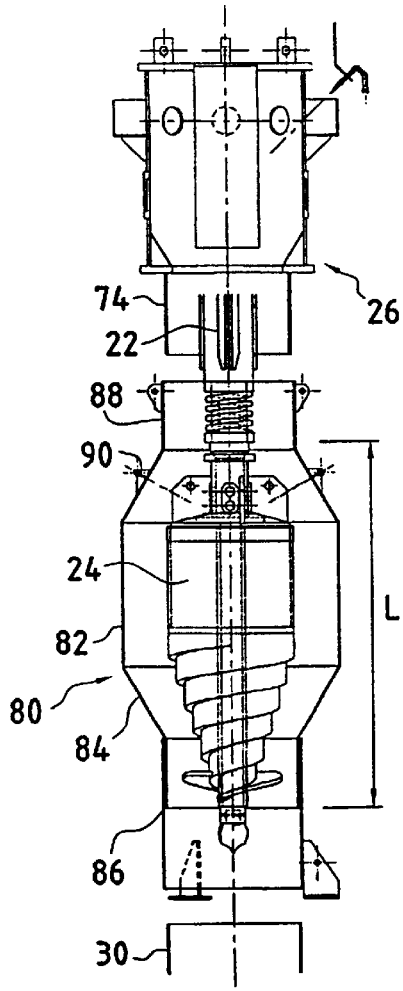

ROTARY DISPLACEMENT PILING EQUIPMENT

BACKGROUND OF THE INVENTION

The present invention relates to a rotary displacement piling equipment.

More precisely, the object of the invention is an equipment to bore a cylindrical hole into the soil, said hole being later fulfilled with concrete or concrete and reinforcement element to complete the pile.

The invention is especially well adapted to the realization of bored piles within contaminated soil. However, the present invention is not limited to this situation.

Rotary displacement piles have been constructed by various methods for more than 20 years but have not been widely used. They are, however, now becoming more popular because of rising spoil disposal costs and increasing difficulty in disposing of contaminated soil.

The system developed by the Fundex company uses a soil displacement cone which is attached to the bottom of a steel casing and screwed into the ground. The cone is left in the ground when the reinforcement and concrete are placed inside the casing to form the pile, which makes the pile expensive. The casing can be left in the ground to protect the concrete if necessary, or can be extracted after the concrete has been placed.

The systems of the Atlas and Omega companies use soil displacement bits which are rotated into the ground without casing to support the soil behind the bit or protect the concrete in the pile, therefore the range of soils in which they can be used is limited.

SUMMARY OF THE INVENTION

The object of the present invention is to provide an equipment for boring holes in the soil in view of making a bored pile which is compatible with a contaminated soil and which allows the consolidation of the soil about the hole to enhance the bearing capacity of the bored pile.

To achieve this object, according to the present invention, the rotary displacement piling equipment comprises:

- a rotary displacement bit;
- rod means having an upper end and a lower end connected to said bit;
- casing means surrounding said driving rod means to be forced down into the soil;
- a casing adapter having a lower end provided with a cylindrical collar for co-operating with the upper part of said casing means for entering said casing means with respect to said driving rod means and with an horizontal thrust face for applying a thrust at the upper end of said casing means, and an upper end, said driving means passing through said casing adapter;
- a rotary drive box co-operating with said driving rod means for rotating said driving rod means, said rotary drive box being provided with connecting means to be connected to the upper end of said casing adapter, whereby said casing adapter is rotated by said rotary drive box; and
- vertical supporting and guiding means for supporting and vertically guiding said rotary drive box.

It is understood that the displacement bit is not connected with the casing. Consequently, the bit can be withdrawn from the hole when the hole is completed and the casing can be left in the ground to protect the concrete of the pile.

Moreover, the soil is displaced laterally by the bit to bore the hole and no significant amount of soil penetrates into the casing above the bit. As a result, when the soil is contaminated, no polluted or contaminated material is to be stored and treated. Additionally, environmental problems are avoided.

According to a preferred embodiment of the invention, the rotary displacement bit comprises:

- a spiral lower portion for laterally displacing the soil when said bit is rotated; and
- an upper cylindrical portion having a diameter slightly smaller than the inner diameter of said casing means; and
- connecting means for fixing said bit at the lower end of said driving rod means.

According to a still preferred embodiment, the casing adapter includes:

- a side wall consisting of an upper section and a lower section, said upper and lower sections being connected by mechanical joint means, and said equipment further comprises an extension piece to be inserted between said upper and lower section of said side wall whereby the distance the lower end of the rotary displacement bit projects ahead the toe of the casing means can be adjusted.

Preferably, the casing adapter further comprises means for producing fluid jets directed to flow within said casing adapter and said casing means.

It is understood that, due to the fluid jets produced within the casing, the dust in the casing is caught. This feature is of particular interest when the soil is contaminated.

According to a preferred embodiment of the invention, the casing is rotated by the casing adapter.

Other features and advantages of the present invention will appear better on reading the following description of several embodiments of the invention given by way of non limiting examples.

BRIEF DESCRIPTION OF THE DRAWINGS

The description refers to the accompanying figures in which:

FIG. 4A is a vertical sectional view of the casing adapter;

FIG. 4B is an enlarged, vertical sectional view of the extension piece;

FIG. 5 is a vertical sectional view of a washing chamber usable with the rotary displacement piling equipment.

DETAILED DESCRIPTION OF THE PREFERRED EMBODIMENTS OF THE INVENTION

Figure 1:
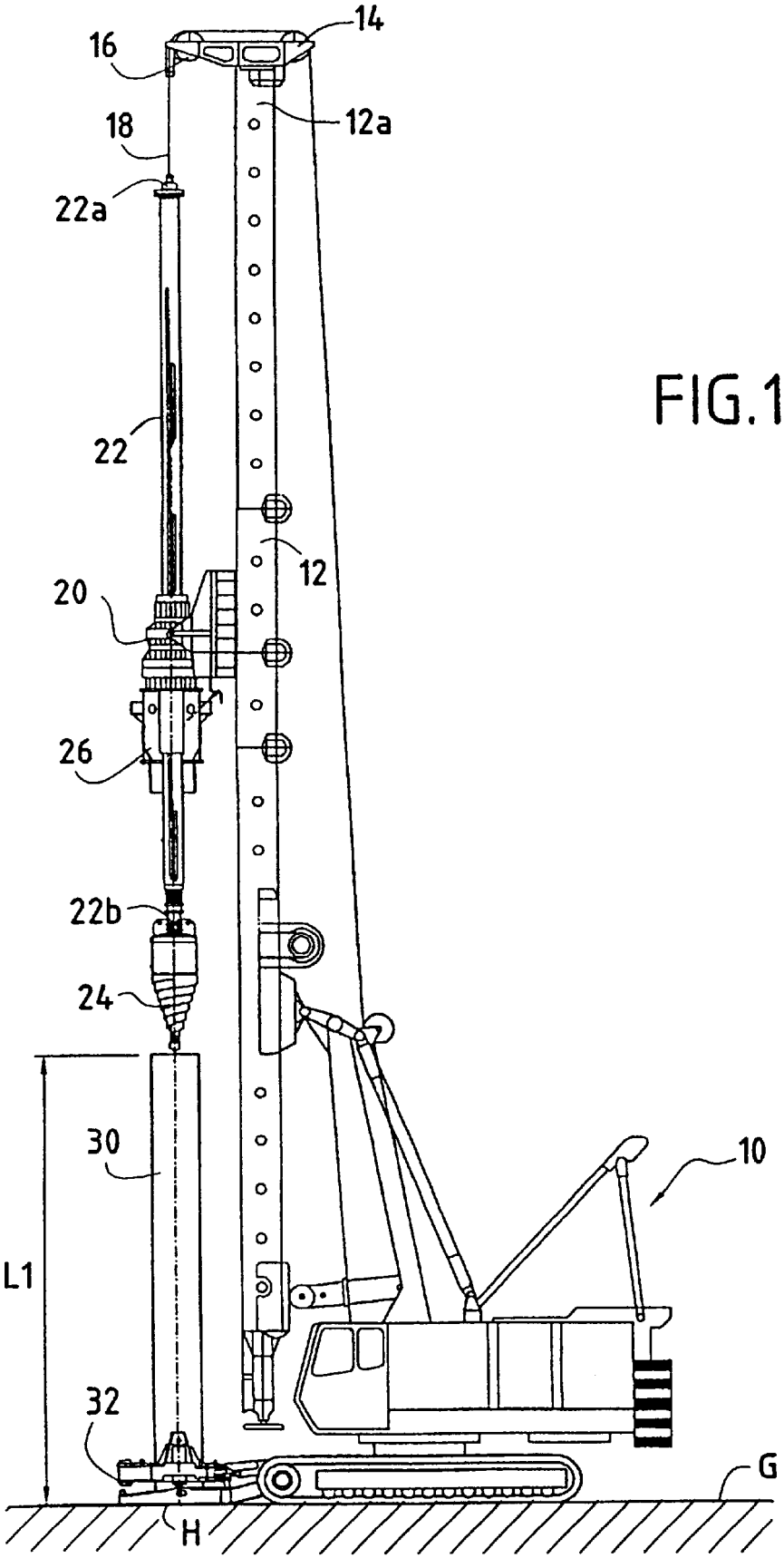
FIG. 1 is a view showing the whole equipment according to the invention.

Referring firstly to FIG. 1, mains parts of the piling equipment will be described.

The equipment comprises a piling rig 10 provided with a vertical mast 12. The upper end 12*a* of the mast is equipped with two pulleys 14, 16 for a cable 18. The mast 12 also forms a vertical guide for a movable rotary drive box 20. The rotary drive box 20 can be moved along the whole length of the mast 12. The equipment further comprises a set of driving rods or Kelly bar 22. The Kelly bar consists of a plurality of steel tubes which are locked one to the other. The upper end 22*a* of the Kelly bar is secured to an end of the cable 18. As a result, the up and down vertical movement of the Kelly bar is controlled by the cable.

The Kelly bar 22 passes through the rotary drive box 20 and the box 20 applies a rotative torque to the Kelly bar 22. However, the Kelly bar can be vertically moved with respect to the box 20. The lower end 22*b* of the Kelly bar is connected to a rotary displacement bit 24 which will be described in more details hereinafter. As a result, the torque produced by the rotary drive box 20 is transmitted to the bit 24 by means of the Kelly bar.

The equipment also comprises a casing adapter 26 which is secured to the lower end of the rotary drive box. The Kelly bar 22 passes freely through the adapter 26, which will be described in more details hereinafter.

FIG. 1 also shows a cylindrical steel casing 30, the inner diameter of which is slightly greater than the outer diameter of the bit 24 so that the bit can pass through the casing. The casing means include a plurality of steel casings 30 having a length $L_1$. For example, $L_1$ is equal to 9.25 m.

The equipment further comprises a casing oscillator 32. This device is placed on the ground surface G around the surface where the hole is bored. The casing oscillator co-operates with the outer face of the casing 30 to oscillate it.

Figure 2:
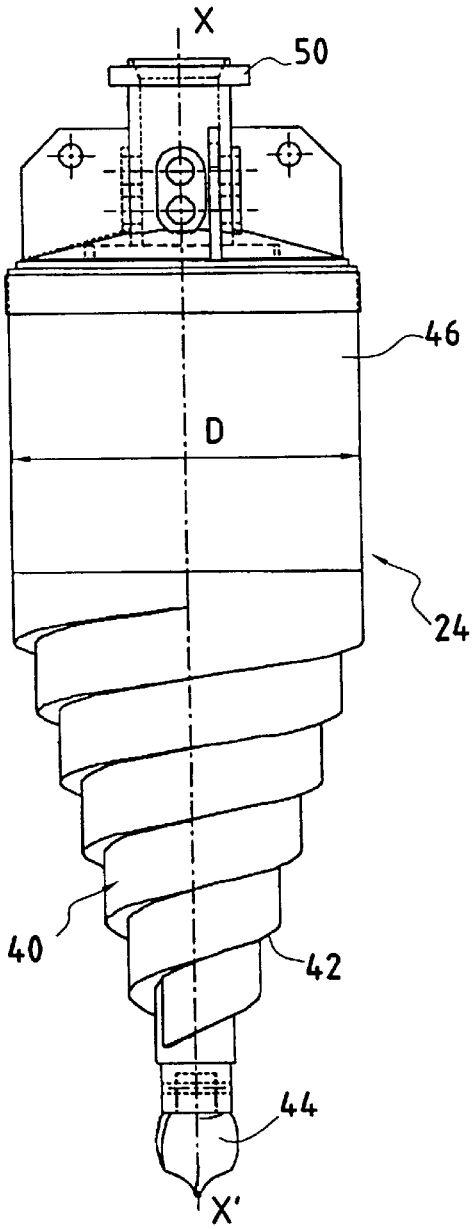
FIG. 2 is a view showing a first embodiment of the rotary displacement bit.

Referring now to FIG. 2, a first embodiment of the rotary displacement bit 24 is shown. The bit comprises a lower section 40, in the form of a single or double spiral 42 having as axis the axis XX' of the bit. The bottom of the lower section 40 is provided with a stinger 44 to assist the penetration of the bit into the soil. The bit also comprises an upper section 46 cylindrical in shape. The diameter D of the cylindrical section 46 is slightly smaller than the inner diameter of the casing 30. At the top of the bit, a connecting system 50 is provided for connecting the bit at the lower end of the Kelly bar 22.

When the bit is rotated, the spiral section 42 displaces laterally the soil to form a hole in the soil. Additionally, due to the small clearance between the cylindrical section 46 of the bit and the inner face of the casing, the soil does not significantly penetrate into the casing above the bit.

Figure 3:
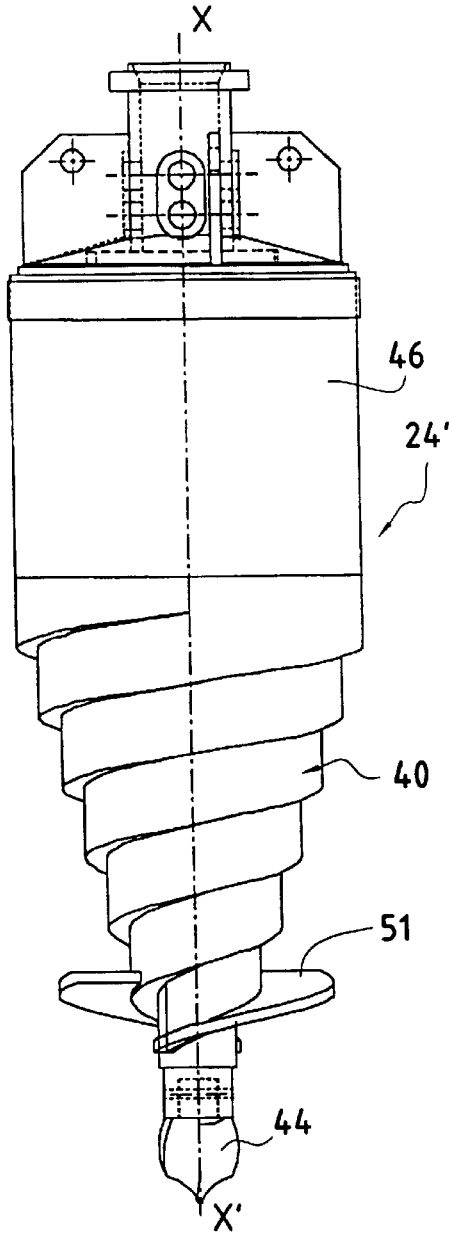
FIG. 3 is a view showing a second embodiment of the rotary displacement bit.

FIG. 3 shows an alternative embodiment of the bit which is referenced 24'. According to this embodiment, the spiral section 40 is equipped with one or more flights 51 to assist penetration of the bit into the soil.

Referring now to FIG. 4, it shows a preferred embodiment of the casing adapter 26. The functions of the casing adapter are to keep the casing 30 in line with the Kelly bar 22 and to transmit downward force from the piling rig to the casing to assist penetration into the soil.

The adapter 26 comprises a cylindrical lateral wall 60 consisting of an upper portion 62 and a lower portion 64 interconnected by means of a mechanical joint 66. An extension piece 100, as show in FIG. 4B, can be inserted between the upper and lower portion of the lateral wall. The purpose of the extension piece is to increase the length of the adapter to suit different lengths of casing. The extension piece also serves as a distance piece to ensure the rotary displacement bit 24 projects the correct distance ahead of the toe of the casing 30 during the boring operation. The relative position of the spiral section of the bit with respect to the lower edge of the casing is essential for the system to function properly.

The adapter also comprises an upper plate 68 provided with an axial opening 70. The plate 68 is secured to the bottom of the rotary drive box. The lower section 64 of the lateral wall of the adapter is secured to an annular horizontal plate 72. This plate serves as a surface to apply a thrust to the upper end of the casing. The lower end of the adapter further comprises a sleeve tube 74 projecting downwardly out of the plate 72. This sleeve is adapted to fit inside the upper end of the casing to act as a vertical guide. The upper section 62 is provided with holes 76 through which a jet of water or other fluid can be directed to flow down into the casing in order to suppress dust produced by the bit during the boring operation or to assist penetration. The jet is produced by a nozzle 78 fixed to the lower end of the rotary drive box 20. Because the adapter rotates, a trough 80 is provided around the lateral wall of the adapter below the holes 76 to catch water or other fluid which does not pass directly through the holes 76 and to redirect it into the casing.

FIG. 5 shows a preferred embodiment of a washing chamber usable with the equipment according to the invention. The washing chamber 80 is used to wash the displacement bit 24 when boring through contaminated soil. The chamber 80 can either be placed on top of the casing 30 or in a suitable container on the ground. In FIG. 5, the chamber 80 is represented between the adapter 26 and the casing 30, the displacement bit being placed within the chamber.

When placed on top of the casing, the bit and Kelly bar pass through the chamber, and the bit is washed as it is withdrawn from the casing. When placed in a container on the ground, the bit is withdrawn from the casing and lowered into the chamber to be washed. The effective length L of the chamber is the same as the distance between the interlocking positions of the Kelly bar therefore no adjustment to the length of the casing is necessary if the chamber is left on top of the casing during the boring operation.

The chamber 80 comprises a cylindrical lateral wall 82, a lower frustro-conical portion 84 and a lower tube sleeve 86 for co-operating with the outside of the upper end of the casing 30. The upper part of the chamber consists of a sleeve 88 for co-operating with the sleeve 74 of the adapter 26. At its upper part, the chamber comprises nozzles 90 to create high pressure water jets inside the chamber. The jets impinge on the bit 24 when it is inside the chamber to wash off any contaminated soil on the bit. The shape of the lower part of the chamber is designed to allow the soil to pass down the sides of the bit either in the casing 30 or into the container.

The operation of the rotary displacement piling equipment will be described now with reference to FIGS. 1 and 6 to 11.

Figure 6:
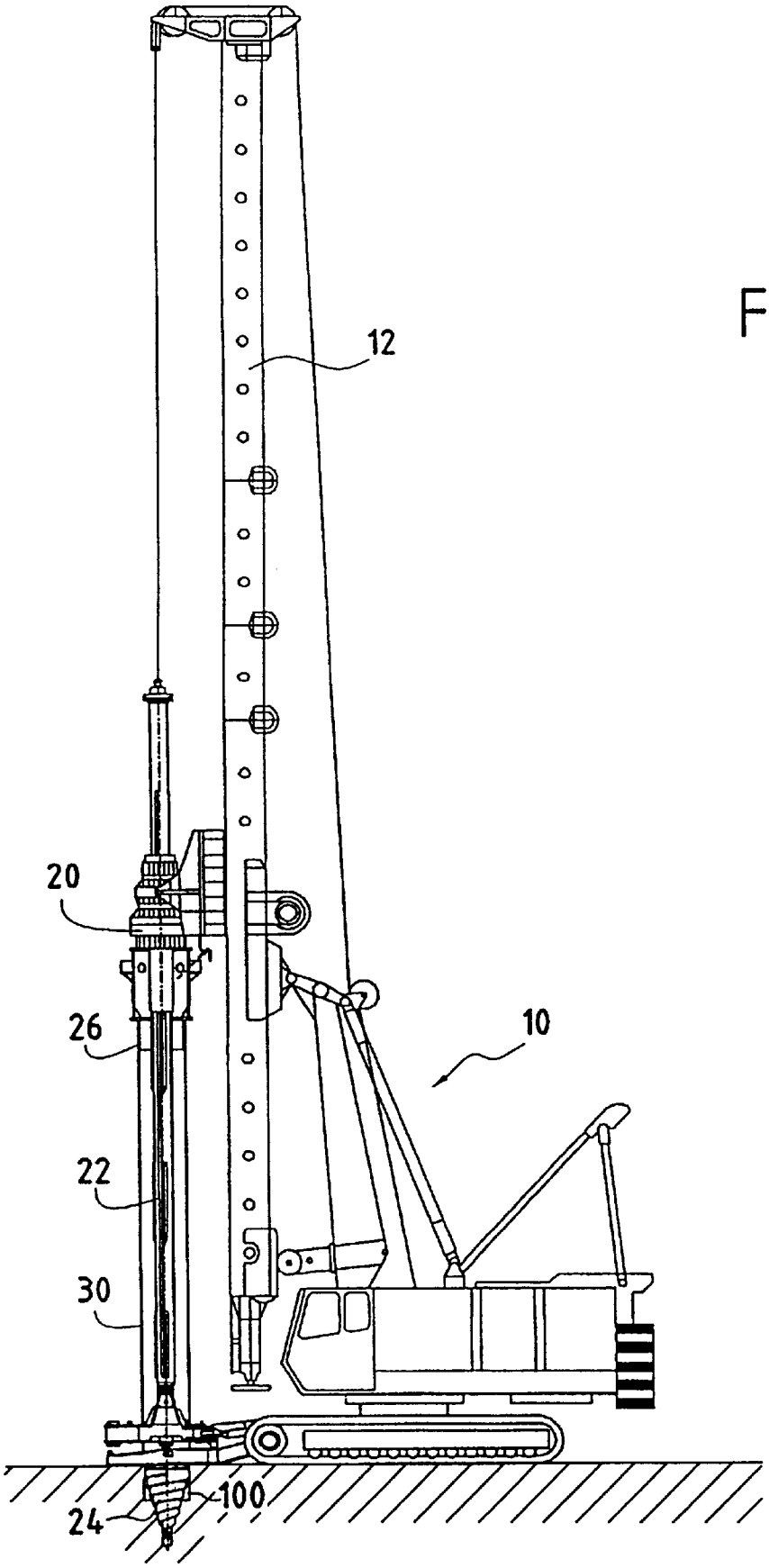
FIGS. 6 to 11 show the different steps of operation of the rotary displacement piling equipment.

At the commencement of the piling operation, the equipment is set up as shown in FIG. 1. The piling rig 10 and casing oscillator 32 are set up at the pile position, and a length $L_I$ of steel casing 30 is lowered through the oscillator by the piling rig or an attendant crane, until the toe of the casing rests on the ground. The rotary displacement bit 24 is then attached to the Kelly bar 22, lowered into the casing, then rotated and forced down a small distance into the soil, as shown in FIG. 6.

Figure 7:
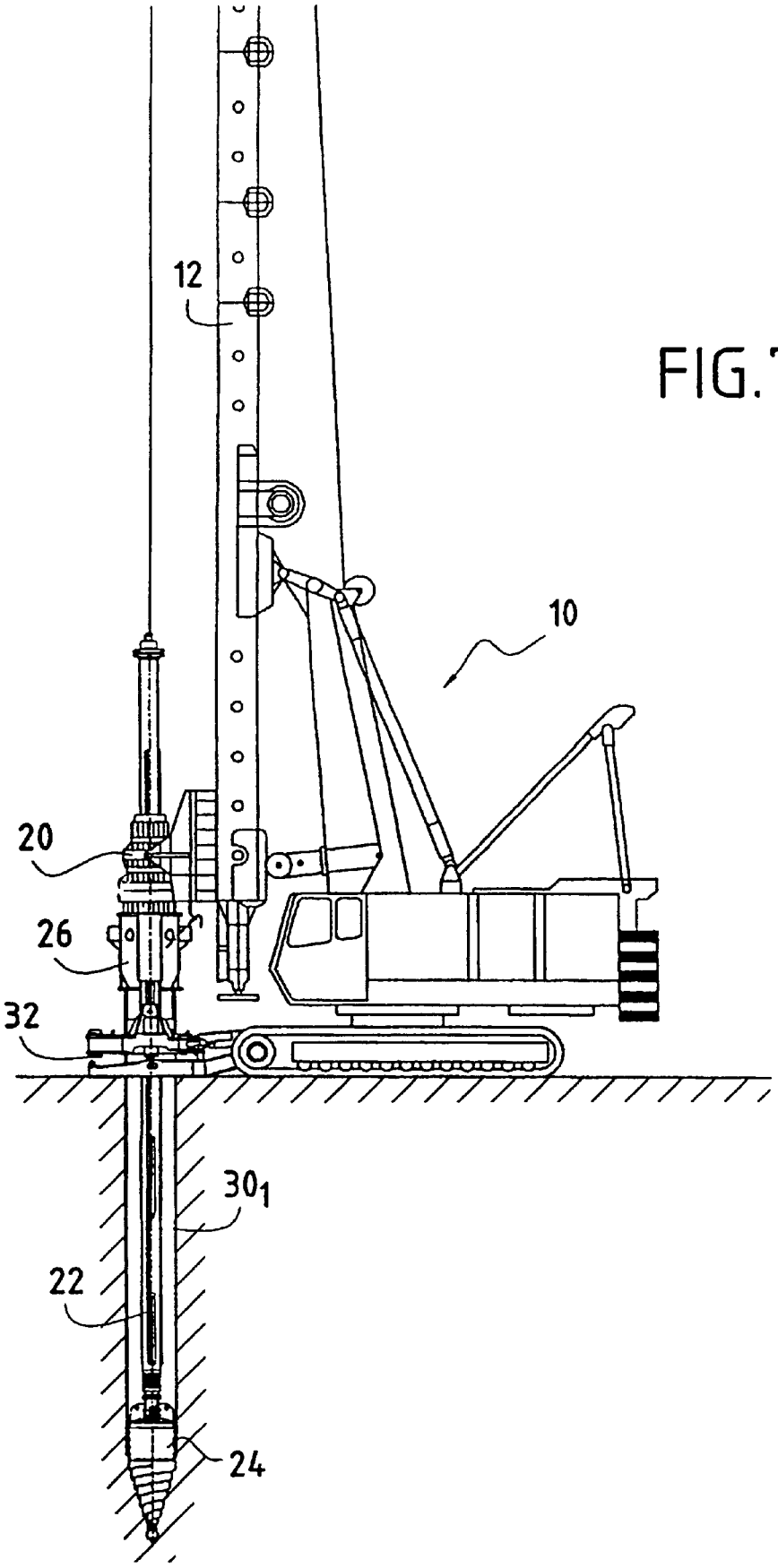
Figure 8:
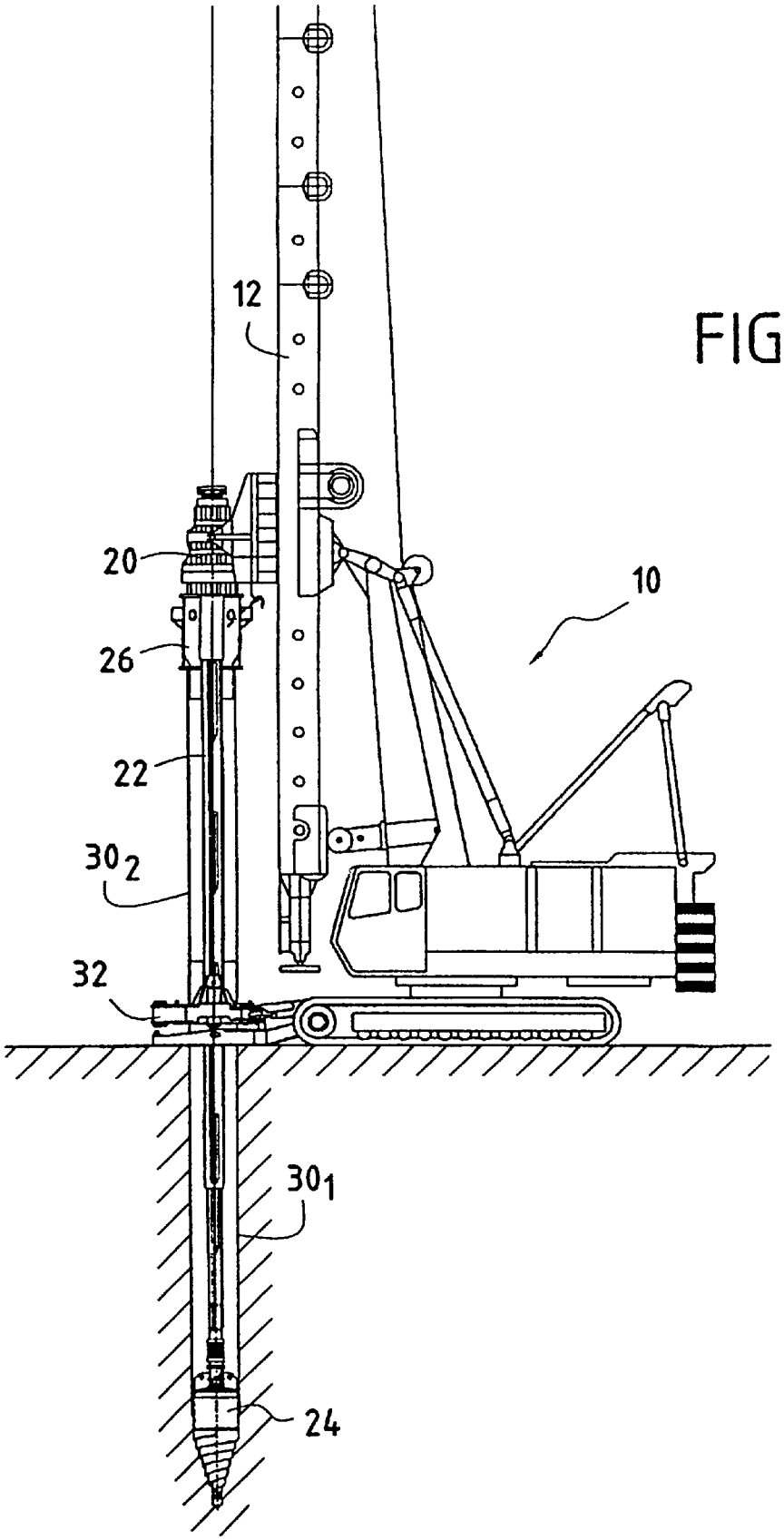

The casing 30 is oscillated into the ground by the casing oscillator 32, assisted by downward force applied by the piling rig. Simultaneously, the displacement bit 24 is rotated ahead of the casing to displace the soil laterally and form a hold 100 into which the casing can follow. FIG. 7 shows the stage of the operation when the first piece of casing $\mathbf{30}_1$ has penetrated into the soil to a depth of, for example, 7.50 meters. At this stage, the displacement bit 24 and Kelly bar 22 are withdrawn from the casing, and a second piece of casing $30_2$ is attached to the top of the first piece $30_1$ by welding or other suitable means. The displacement bit 24 and Kelly bar 22 are then lowered back into the casing ready for boring to continue, as shown in FIG. 8.

The Kelly bar consists of two or more concentrically arranged tubular steel sections which interlock at various positions to allow it to be extended to a predetermined length. The distance from the thrust plate on the casing adapter to the point where the bit projects ahead of the casing determines the length of the casing.

Figure 9:
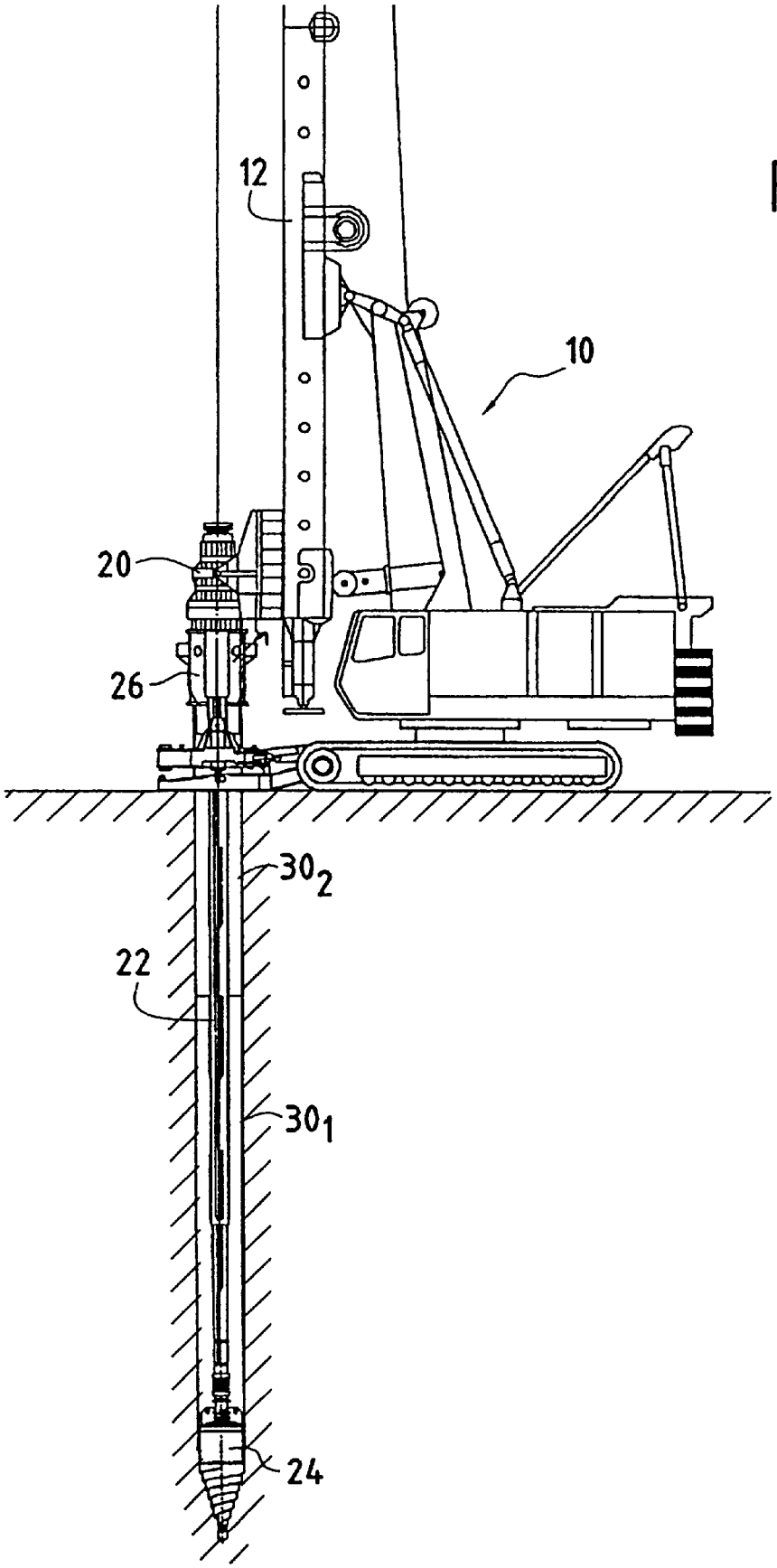
Figure 10:
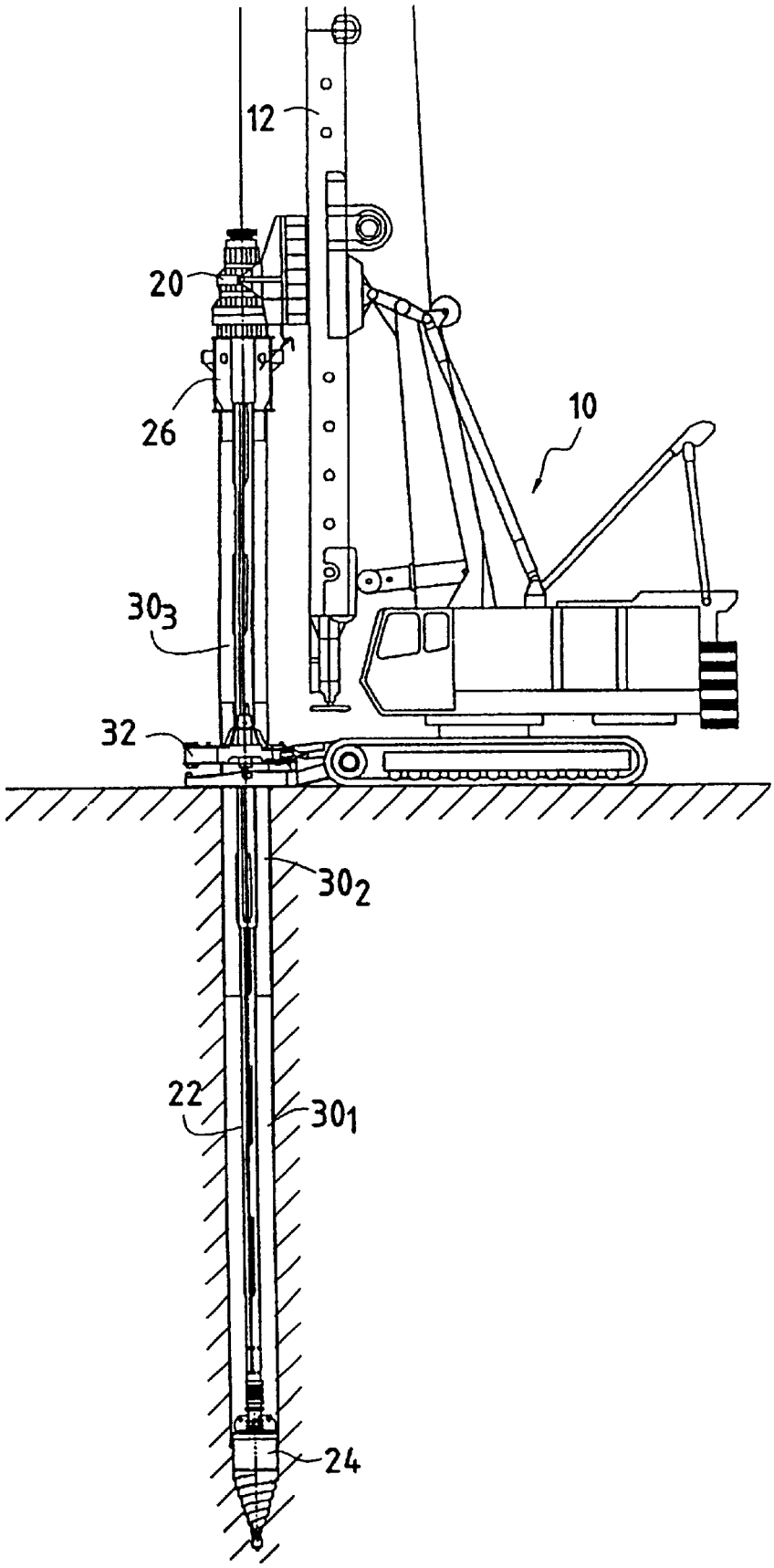

FIG. 9 shows the stage at which the first piece of casing $30_1$ and, for example, 4.25 meters of the second piece $30_2$ have penetrated into the soil. At this stage, the displacement bit and Kelly bar are withdrawn from the casing, and a third piece of casing $30_3$ is attached to the top of the second piece by welding or other suitable means. The displacement bit and Kelly bar are then lowered back into the casing, as before, and boring continues, as shown in FIG. 10.

Figure 11:
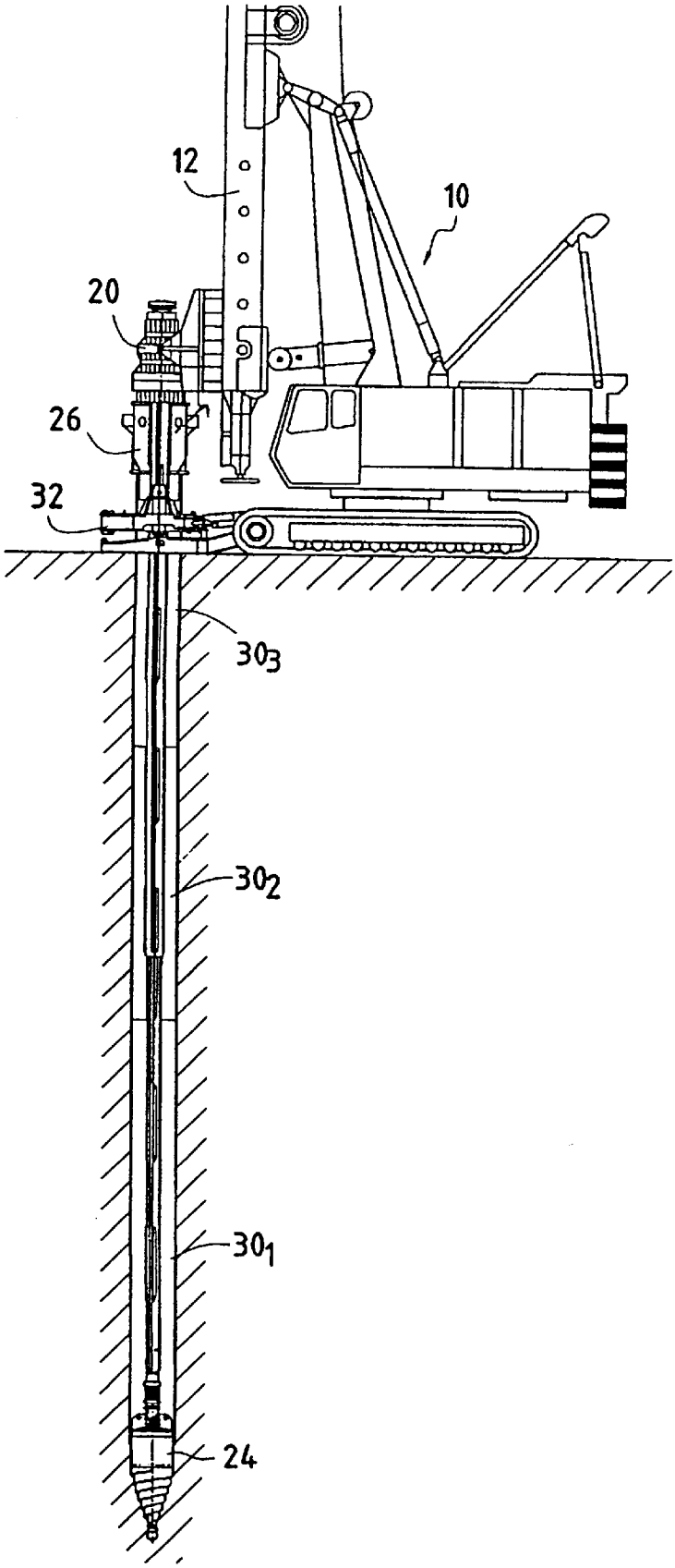

FIG. 11 shows the final stage of the casing installation sequence when the first $30_1$ and second $30_2$ pieces of casing and, for example, 4.25 meters of the third piece $30_3$ have penetrated into the soil. At this stage, the displacement bit and Kelly bar are withdrawn from the casing in readiness for completion of the pile.

Steel reinforcement and concrete are placed inside the casing to complete the pile. The casing can be left in the ground to protect the concrete or withdrawn from the ground if no protection is necessary. Alternatively, the pile length may be extended by boring below the casing with an auger or other suitable tool before the reinforcement and concrete are placed.

The casing lengths and number of pieces can be varied to suit the ground conditions, but it is an advantage to keep the number of casing elements to a minimum to speed up the operation and reduce costs.

According to an alternative embodiment, the casing 30 can be rotated by the casing adapter 26. To this purpose, the horizontal annular plate 72 of the adapter is provided with two or more casing drive bars which engage corresponding slots provided at the top of the casing 30 when the thrust plate 72 is applied against the casing. The rotation of the casing improves the casing installation and speeds it up. However, the casing oscillator 32 is maintained in front of the piling rig 10 in case the rig does not have sufficient power to rotate the casing to the full depth.

What is claimed is:

1. A rotary displacement piling equipment for boring a hole within the soil comprising:

a rotary displacement bit;

driving rod means having an upper end and a lower end connected to said bit;

casing means surrounding said driving rod means to be forced down into the soil;

a casing adapter having an upper end and a lower end, the lower end provided with a cylindrical collar for co-operating with an upper part of said casing means for keeping in line said casing means with respect to said driving rod means and with an horizontal thrust face for applying a thrust at the upper part of said casing means, and said driving rod means passing through said casing adapter;

a rotary drive box co-operating with said driving rod means for rotating said driving rod means, said rotary drive box being provided with connecting means to be connected to the upper end of said casing adapter, whereby said casing adapter is rotated by said rotary drive box; and vertical supporting and guiding means for supporting and vertically guiding said rotary drive box.

2. The equipment of claim 1, wherein said rotary displacement bit comprises:

a spiral lower portion for laterally displacing the soil when said bit is rotated;

an upper cylindrical portion having a diameter slightly smaller than the inner diameter of said casing means; and connecting means for fixing said bit at the lower end of said driving rod means.

3. The equipment of claim 2, wherein said casing adapter includes a side wall consisting of an upper section and a lower section, said upper and lower sections being connected by mechanical joint means and in that said equipment further comprises an extension piece to be inserted between said upper and lower section of said side wall whereby the distance that the lower end of the rotary displacement bit projects ahead the toe of the casing means can be adjusted.

4. The equipment of claim 3, wherein said casing adapter further comprises means for producing fluid jets directed to flow within said casing adapter and said casing means.

5. The equipment of claim 1, wherein said casing adapter includes a side wall consisting of an upper section and a lower section, said upper and lower sections being connected by mechanical joint means and in that said equipment further comprises an extension piece to be inserted between said upper and lower section of said side wall whereby the distance that the lower end of the rotary displacement bit projects ahead the toe of the casing means can be adjusted.

6. The equipment of claim 1, wherein said casing adapter further comprises means for producing fluid jets directed to flow within said casing adapter and said casing means.

7. The equipment of claim 1, further comprising casing oscillator means to be placed on the ground around the zone where the hole is to be bored, said casing oscillator means being adapted to oscillate said casing means.

8. The equipment of claim 1, further comprising a washing chamber comprising a lateral wall and means for producing a plurality of high pressure jets directed towards the interior of said lateral wall to wash said rotary displacement bit when it is disposed within said washing chamber.

9. The equipment of claim 8, wherein said washing chamber further comprises first connecting means disposed at the upper end of said lateral wall for connection to the lower end of said casing adapter and second connection means disposed at the lower end of said lateral wall for connection with the upper end of said casing means.

* * * * *